US006854411B2

(12) United States Patent
Ankarsward

(10) Patent No.: US 6,854,411 B2
(45) Date of Patent: Feb. 15, 2005

(54) SEMI-SUBMERSIBLE OFFSHORE PLATFORM AND METHODS FOR POSITIONING OPERATION MODULES ON SAID PLATFORM

(75) Inventor: Peter Ankarsward, Vastra Frolunda (SE)

(73) Assignee: GVA Consultants AB, Gothenburg (SE)

( * ) Notice: Subject to any disclaimer, the term of this patent is extended or adjusted under 35 U.S.C. 154(b) by 0 days.

(21) Appl. No.: 10/602,712

(22) Filed: Jun. 25, 2003

(65) Prior Publication Data

US 2004/0159274 A1 Aug. 19, 2004

(30) Foreign Application Priority Data

Feb. 18, 2003 (SE) ..... 0300452

(51) Int. Cl.[7] ..... B63B 35/44
(52) U.S. Cl. ..... 114/265
(58) Field of Search ..... 114/264, 265, 114/266; 405/195.1, 203, 207, 223.1, 224, 224.2

(56) References Cited

U.S. PATENT DOCUMENTS 4,350,014 A * 9/1982 Sanchez et al. ..... 60/641.7
5,135,327 A 8/1992 White et al.
5,575,592 A 11/1996 Pollack
6,247,421 B1 * 6/2001 Ludwigson ..... 114/265
6,447,208 B1 * 9/2002 Huang et al. ..... 405/224
6,652,192 B1 * 11/2003 Xu et al. ..... 405/195.1

FOREIGN PATENT DOCUMENTS

| | | |
|---|---|---|
| GB | 2 259 536 | 3/1993 |
| GB | 2 296 686 | 7/1996 |
| GB | 2 306 137 | 4/1997 |
| WO | WO96/23690 | 8/1996 |
| WO | WO01/03999 A1 | 1/2001 |

* cited by examiner

*Primary Examiner*—Stephen Avila
(74) *Attorney, Agent, or Firm*—Birch, Stewart, Kolasch & Birch, LLP

(57) ABSTRACT

A semi-submersible offshore platform (1) comprising:

a substantially ring-shaped lower pontoon (2);

at least three columns (4) extending upwardly from said lower pontoon (2), and an upper beam structure (5) connecting upper portions (6) of the columns (4) with each other.

According to the invention, said upper beam structure (5) forms a system of lateral beams (7), arranged in such a way as to allow one or more operation modules (8) to be placed upon or adjacent to the columns (4) next to the lateral beams (7), either directly on the columns (4), on brackets (10) connected to the columns (4) or on a deck (9) arranged between upper ends (6) of the columns (4) and said operation modules (8), the lateral beams (7) protruding vertically upwards above a bottom plane (11) of the operation modules, said operation modules (8) containing, for example, hydrocarbon processing equipment and/or accommodation quarters.

17 Claims, 6 Drawing Sheets

SEMI-SUBMERSIBLE OFFSHORE PLATFORM AND METHODS FOR POSITIONING OPERATION MODULES ON SAID PLATFORM

TECHNICAL FIELD

The present invention relates to a semi-submersible offshore platform comprising a substantially ring-shaped lower pontoon, at least three columns extending upwardly from said lower pontoon, and an upper beam structure connecting upper portions of the columns with each other. The offshore platform is especially designed to be fitted with one or more operation modules containing, for example, hydrocarbon processing equipment or accommodation quarters. The invention also discloses methods for positioning operation modules on said platform.

BACKGROUND

In conventional semi-submersible platforms, a load-supporting, rectangular deck-box structure is positioned upon the top of the columns. Operation modules are then placed on top of the deck-box structure. The deck-box structure offers a structurally solid design and may be of a sealed type which adds reserve buoyancy to the platform in an eventual damaged emergency state. However, a problem with this conventional design is that the operational modules have to be placed relatively high on the platform which leads to a high center of gravity for the platform. This results in a reduction in stability for the platform and as a consequence—a lesser pay-load, unless the size of the platform is increased as a compensation.

The semi-submersible platform is used for various services such as production of hydrocarbons, drilling and/or to provide accommodation for personnel. To provide these services, the platform is equipped with various equipment and systems, which may either be located directly in the deck-box structure or upon the the deck-box structure.

In a conventional semi-submersible platform, the operational modules—due to their size and to existing installation methods—are placed upon the deck-box structure, either by lifting or by an operation where the modules are skidded over from a barge.

However, from a construction and contracting point of view it can in certain cases be advantageous to locate the equipment and systems in separate operational modules that can be fabricated/contracted separately from the platform.

However, a disadvantage with this conventional design is that the operational modules have to be placed relatively high on the platform which leads to a high center of gravity for the operational modules, and accordingly for the completed platform. This results in a reduction in stability for the platform and as a consequence—a lesser pay-load, or alternatively the size of the platform has to be increased to compensate for the high vertical center of gravity of the operational modules. Furthermore, the weight and the size of these operational modules are normally such that there is only a limited number of devices available that can lift them, a fact that limits the number of available construction sites worldwide.

SUMMARY OF THE INVENTION

The above-mentioned problem is solved by A semi-submersible offshore platform comprising:

a substantially ring-shaped lower pontoon;

at least three columns extending upwardly from said lower pontoon, and an upper beam structure connecting upper portions of the columns with each other.

According to the invention, said upper beam structure forms a system of lateral beams, arranged in such a way as to allow one or more operation modules to be placed upon or adjacent to the columns next to the lateral beams, either directly on the columns, on brackets connected to the columns or on a deck arranged between an upper end of the columns and said operation modules, the lateral beams protruding vertically upwards above a bottom plane of the operation modules, said operation modules containing, for example, hydrocarbon processing equipment and/or accommodation quarters.

In one embodiment of the invention, said bottom plane of the operation modules substantially coincides with a lowest through-going deck of the offshore platform.

In a suitable embodiment, the system of lateral beams is arranged in such a way as to allow the operation modules to extend between two adjacent columns.

In one embodiment, the offshore platform has four or six columns and a substantially rectangular pontoon A forward column pair is located on the pontoon with one column thereof on each side of a longitudinal center-line, and an aft column pair is located on the pontoon with one column thereof on each side of said center-line. The system of lateral beams is substantially H-shaped—when observed from above—in such a way that the vertical posts of the "H" correspond to two or more longitudinal beams extending on each side of said center-line from the aft column pair to the forward column pair. The horizontal mid-post of the "H" corresponds to one or more transversal beams.

In a versatile embodiment, the horizontal mid-post of the "H" corresponds to an at least partially vertically open grid section extending between said longitudinal beams.

In another embodiment, the offshore platform has four or six columns and a substantially rectangular pontoon. A starboard column pair is located on the pontoon with one column thereof on each side of a transversal midship-line through the offshore platform, and a port column pair is located on the pontoon with one column thereof on each side of said midship-line. The system of lateral beams is substantially H-shaped—when observed from above—in such a way that the vertical posts of the "H" correspond to two or more transversal beams extending on each side of said midship-line from the port column pair to the starboard column pair. The horizontal mid-post of the "H" corresponds to one or more longitudinal beams. In an advantageous embodiment, the horizontal mid-post of the "H" corresponds to an at least partially vertically open grid section extending between said transversal beams.

In yet an alternative embodiment, the offshore platform has three columns and a substantially triangular pontoon. Here, the system of lateral beams is substantially T-shaped—when observed from above—in such a way that the horizontal part of the "T" corresponds a first beam extending between two columns, and wherein the vertical part of the "T" corresponds to a second beam which extends from a third column to a mid-portion of said first beam. In a suitable version of this embodiment, a third beam is arranged as a "foot" of the "T", said third beam being substantially perpendicular to the second beam.

Suitably, one or more of the lateral beams are formed as one or more of the lateral beams are formed as a torsion box, said torsion box being wider than a typical beam in the system of lateral beams.

In an advantageous embodiment, at least one side-wall of said torsion box coincides with a side-surface of a column.

Preferably, the torsion box is sealed from water-intrusion in such a way that it provides additional emergency buoyancy to the offshore platform.

In one embodiment of the invention, the torsion box has a width which corresponds to the width of a column which supports the torsion box.

In another embodiment, the torsion box is narrower than a column which supports the torsion box, at least one side-wall of the torsion box coinciding with an internal bulkhead in the column. Said internal bulkhead may preferably be a center-line bulkhead in the column.

The invention also provides a first method for positioning an operation module on the semi-submersible offshore platform. This method involves ballasting the offshore platform to a level at which a floating barge or other vessel, with the operational module placed transversely on its deck, may be floated in between two columns to a position in which two end-portions of the operation module are placed above a respective support surface on the columns, on brackets connected to the columns or on a deck arranged between upper ends of the columns and said operation module. The barge or other vessel is then ballasted so that the operation module is set down on the offshore platform.

Furthermore, the invention also provides a second, alternative method for positioning an operation module on the semi-submersible offshore platform. According to this method, the offshore platform is ballasted to a level at which a floating barge or other vessel with the operational module placed transversely on its deck, may be floated in between two columns to a position in which two end-portions of the operation module are placed above a respective support surface on the columns, on brackets connected to the columns or on a deck arranged between upper ends of the columns and said operation module. The offshore platform is then de-ballasted so that the operation module is lifted off said barge or other vessel.

The invention offers a number of advantages over conventional designs, the most notable being a comparatively low positioning of the operational modules, which results in a reduced vertical center of gravity for the platform. Hence, one can make the platform smaller with a retained payload in comparison with conventional platform. Furthermore, the system of lateral beams makes it possible to reduce steel weight in comparison to a conventional fully covering deck-box, which apart from saving costs also results in lower mooring loads. Moreover, the installation method for the operation modules of the "Float over, set-down"-type, considerably simplifies and speeds up installation.

Other features and advantages of the invention will be further described in the following detailed description of embodiments.

BRIEF DESCRIPTION OF THE DRAWINGS

The invention will now be described in greater detail by way of example only and with reference to the attached drawings, in which.

DESCRIPTION OF EMBODIMENTS

Figure 1:
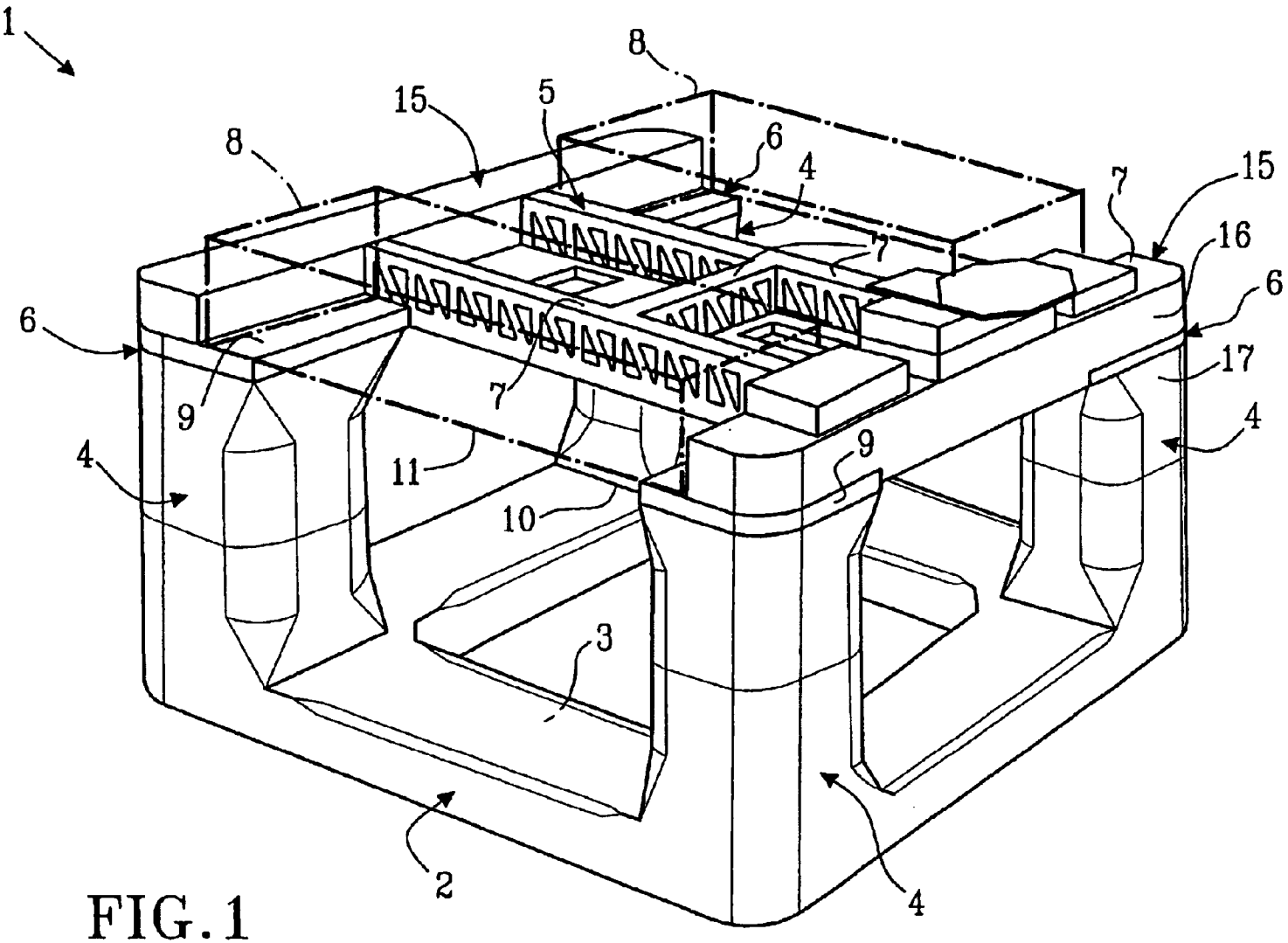
FIG. 1 shows a schematic perspective view of a semi-submersible offshore platform according to a first embodiment of the invention, the operation modules being shown with dash-dotted lines.

In FIG. 1, reference numeral 1 denotes a semi-submersible offshore platform according to a first embodiment of the invention. The offshore platform 1 comprises a substantially ring-shaped lower pontoon 2. By the term "substantially ring shaped" is meant a closed pontoon structure which encloses a central opening 3, also frequently referred to as a "ring-pontoon". Thus the pontoon 2 shown in FIG. 1 is generally rectangular, whereas alternative embodiments may include triangular (as shown in FIG. 10) or even circular pontoons 2 (not shown).

In the shown embodiment, four columns 4 extend vertically upwardly from the lower pontoon 2. The columns 4 have a rounded rectangular cross-section. An upper beam structure 5 connects upper ends 6 of the columns 4 with each other in order to form a globally strong and resilient platform design. The upper beam structure 5 forms a system of lateral beams 7, arranged in such a way as to allow one or more operation modules 8 (drawn with dash-dotted lines in FIG. 1) to be placed upon or adjacent to the columns 4 next to the lateral beams 7. The operation modules 8 may for example contain hydrocarbon processing equipment or accommodation quarters. In the embodiment shown in FIG. 1, the operation modules 8 are placed on a thin deck 9 arranged between the upper ends 6 of the columns 4 and the operation modules 8.

In alternative embodiments, the operational modules 8 may be placed directly on the columns (not shown) or on brackets 10 connected to the columns 4 (as will be described below with reference to FIG. 4).

The lateral beams 7 protrude vertically upwards above a bottom plane 11 of the operation modules 8 as can be clearly seen in FIG. 1. The bottom plane 11 of the operation modules 8 substantially coincides with the deck 9, which is also the lowest through-going deck (or main-deck) of the offshore platform 1.

As is further shown in FIG. 1, the system of lateral beams 7 is arranged in such a way as to allow the operation modules 8 to extend between two adjacent columns 4.

Figure 2:
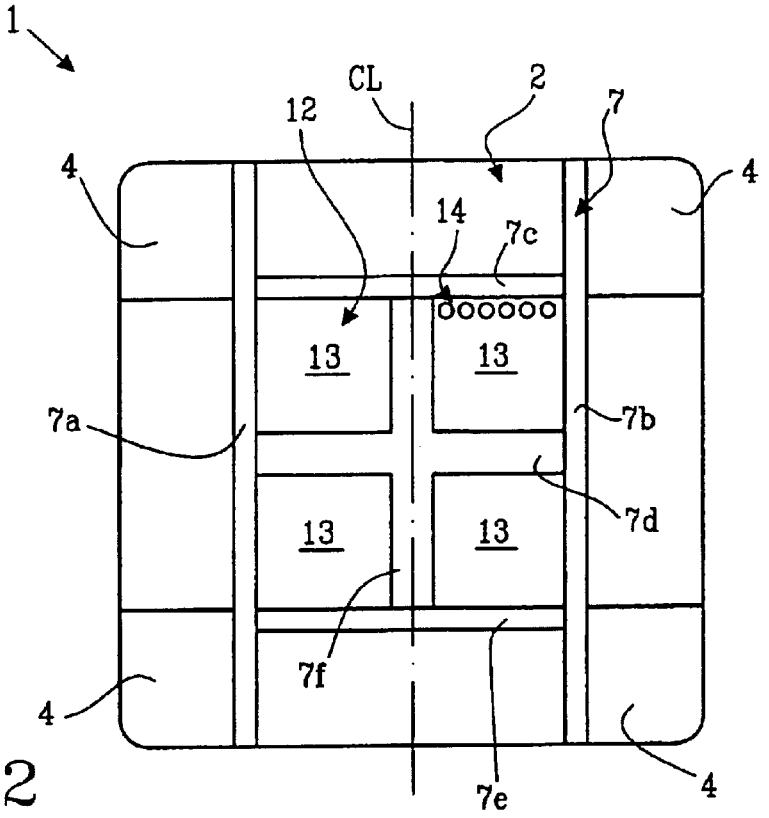
FIG. 2 shows a diagrammatic top view of an embodiment wherein the system of lateral beams are shaped as an "H" oriented in the stern-bow direction of the platform.
Figure 4:
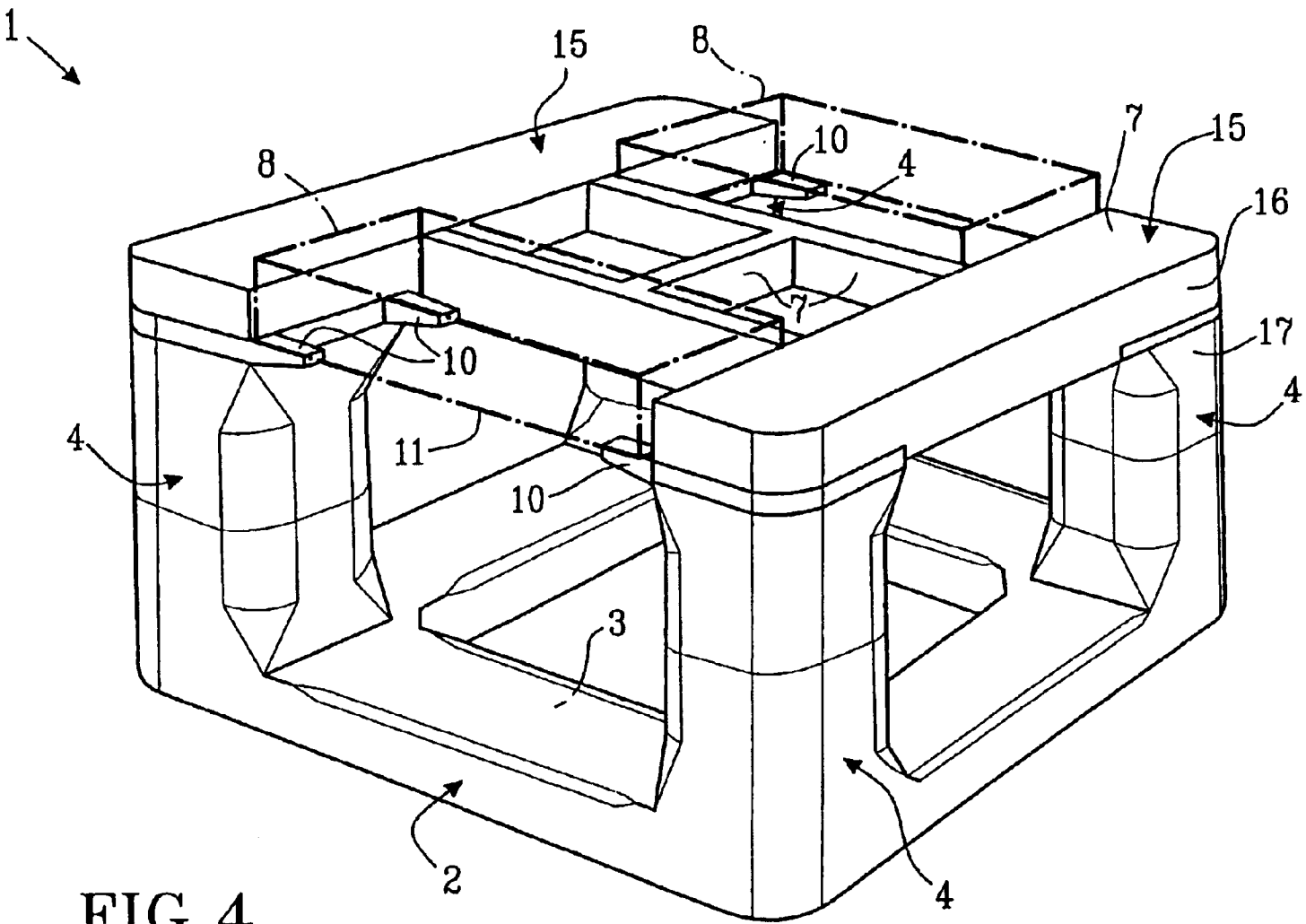
FIG. 4 shows a schematic perspective view of a semi-submersible offshore platform according to a second embodiment of the invention, wherein the system of lateral beams includes two parallel torsion boxes which are as broad as their supporting columns. The operation modules are placed on supporting brackets attached to the columns.

With reference now to FIG. 4, an embodiment with four generally rectangular columns 4 and a substantially rectangular pontoon 2 is shown. A forward column pair is located on the pontoon 2 with one column 4 thereof on each side of a longitudinal center-line CL (the upper two columns 4 in the figure), and an aft column pair (the lower two columns 4 is located on the pontoon 2 with one column 4 thereof on each side of said center-line CL. The system of lateral beams 7 is substantially H-shaped—when observed from above as in FIG. 2—in such a way that the vertical posts of the "H" correspond to two longitudinal beams 7*a*, 7*b* extending on each side of said center-line CL from the aft column pair to the forward column pair, whilst the horizontal mid-post of the "H" corresponds to three transversal beams 7*c*, 7*d*, 7*e*. It should be noted that in alternative, not shown embodiments there may be more than two longitudinal beams 7*a*, 7*b* just as there may be two or more transversal beams 7*c*, 7*d*, 7*e*. As is illustrated in FIG. 2, the horizontal mid-post of the "H" corresponds to an at least partially vertically open grid section 12 extending between said longitudinal beams 7*a*, 7*b*. This open grid section 12 is formed together with the transversal beams 7*c*, 7*d*, 7*e* by an additional longitudinal beam 7*f* which extends along the centerline CL and between said transversal beams 7*c*, 7*d*, 7*e*. For example, riser pipe arrangements 14 may conveniently pass through openings 13 in the grid system 12. A similar design is applicable to a platform 1 with six or more columns 4 (not shown).

Figure 3:
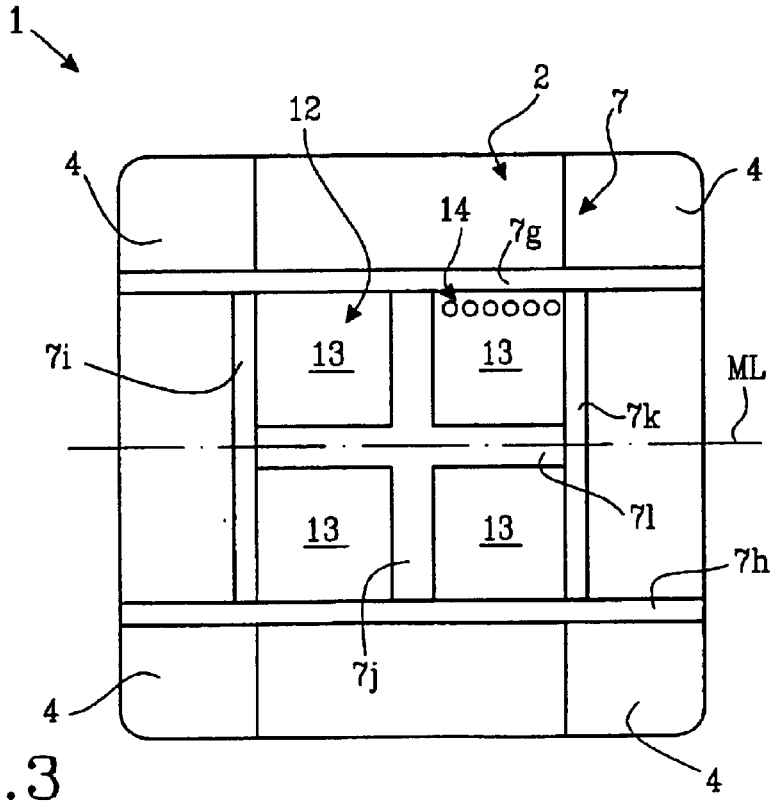
FIG. 3 shows shows a diagrammatic top view of another embodiment wherein the system of lateral beams are shaped as an "H" oriented in port-starboard direction of the platform.

In FIG. 3, an offshore platform 1 according to an alternative embodiment is shown in a similar manner as in FIG. 2. Here, the offshore platform 1 also has four columns 4 and a substantially rectangular pontoon 2. A starboard column pair (the two columns to the right in FIG. 3) is located on the pontoon 2 with one column 4 thereof on each side of a transversal midship-line ML through the offshore platform 1, and a port column pair (the two columns 4 to the left in FIG. 3) is located on the pontoon 2 with one column 4 thereof on each side of said midship-line ML. Like in the previously shown embodiment in FIG. 2, the system of lateral beams 7 is substantially H-shaped—when observed from above—only here, the "H" is orientated transversely on the platform 1 in the figure instead of longitudinally, in such a way that the vertical posts of the "H" correspond to two transversal beams 7*g*, 7*h* extending on each side of said midship-line ML from the port column pair to the starboard column pair, whilst the horizontal mid-post of the "H" corresponds to three longitudinal beams 7*i*, 7*j*, 7*k*. Like in the embodiment in FIG. 2, the horizontal mid-post of the "H" corresponds to an at least partially vertically open grid section 12, only here it extends between the transversal beams 7*g*, 7*h*. This open grid section 12 is formed together with the longitudinal beams 7*i*, 7*j*, 7*k* by an additional longitudinal beam 7*f* which extends along the centerline CL and between said longitudinal beams 7*i*, 7*j*, 7*k*. As in FIG. 2, riser pipe arrangements 14 may conveniently pass through openings 13 in the grid system 12. A similar design is applicable to a platform 1 with six or more columns 4 (not shown).

In the embodiments shown in FIGS. 1 and 4, two of the lateral beams 7 are formed as torsion boxes 15 for obtaining increased global torsional resistance of the platform 1. The two torsion boxes 15 extend parallelly with respect to each other in the shown examples and are wider than a typical beam in the system of lateral beams 7 (as seen extending between the torsion boxes 15.). In alternative, not shown embodiments, the system of lateral beams 7 may include more than two torsion boxes 15 (not shown).

Preferably, each torsion box 15 is sealed from water-intrusion in such a way that it provides additional reserve buoyancy to the offshore platform 1. Common to both embodiments shown in FIGS. 1 and 4 is that at least one side-wall 16 of each torsion box 15 coincides with a side-surface 17 of a column 4.

Figure 5:
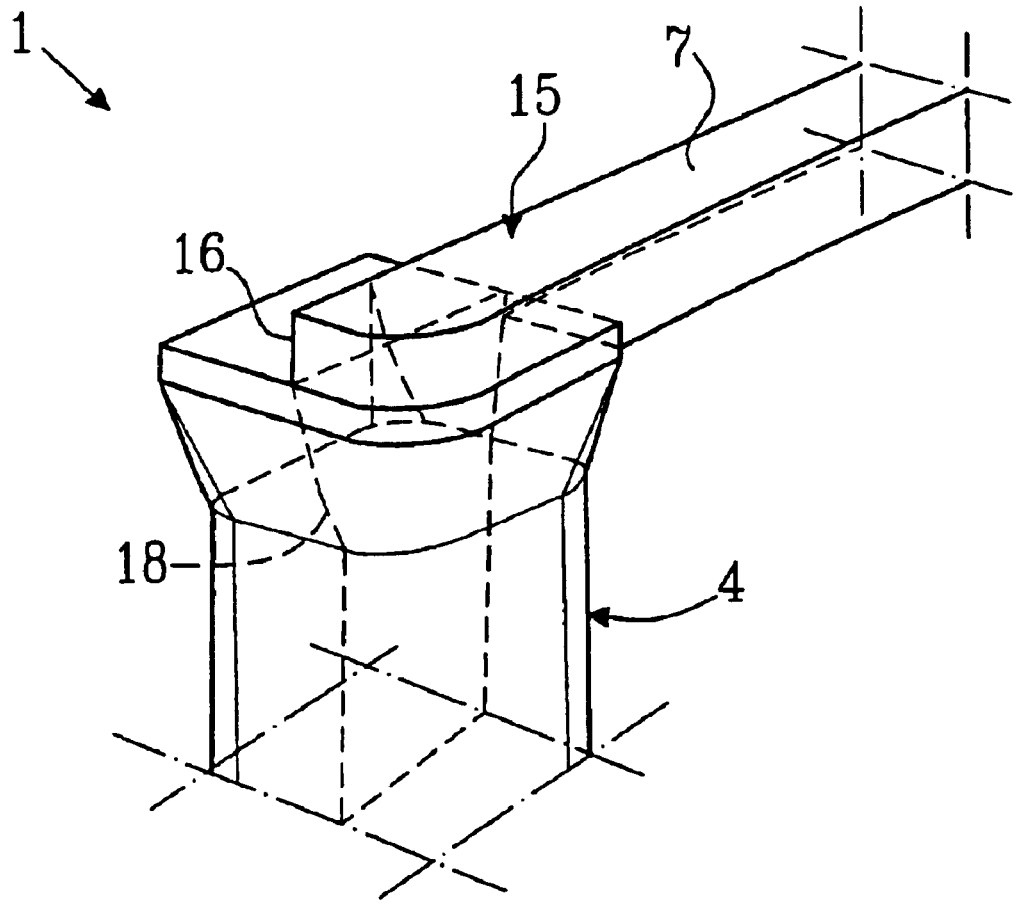
FIG. 5 shows partially cut perspective view of an embodiment wherein the torsion boxes are narrower than the columns, and where one side-wall of the torsion box coincides with an internal bulkhead in the column.

In FIG. 4, each of the two torsion boxes 15 has a width which corresponds to the width of a column 4 which supports the torsion box 15. In FIG. 1 on the other hand, each of the two torsion boxes is narrower than a column 4 which supports the torsion box 15. Here, at least one side-wall 16 of the torsion box 15 coincides with an internal bulkhead 18 in the column 4, as illustrated in the partially cut view in FIG. 5. Preferably, said internal bulkhead 18 is a center-line bulkhead in the column 4.

Figure 6:
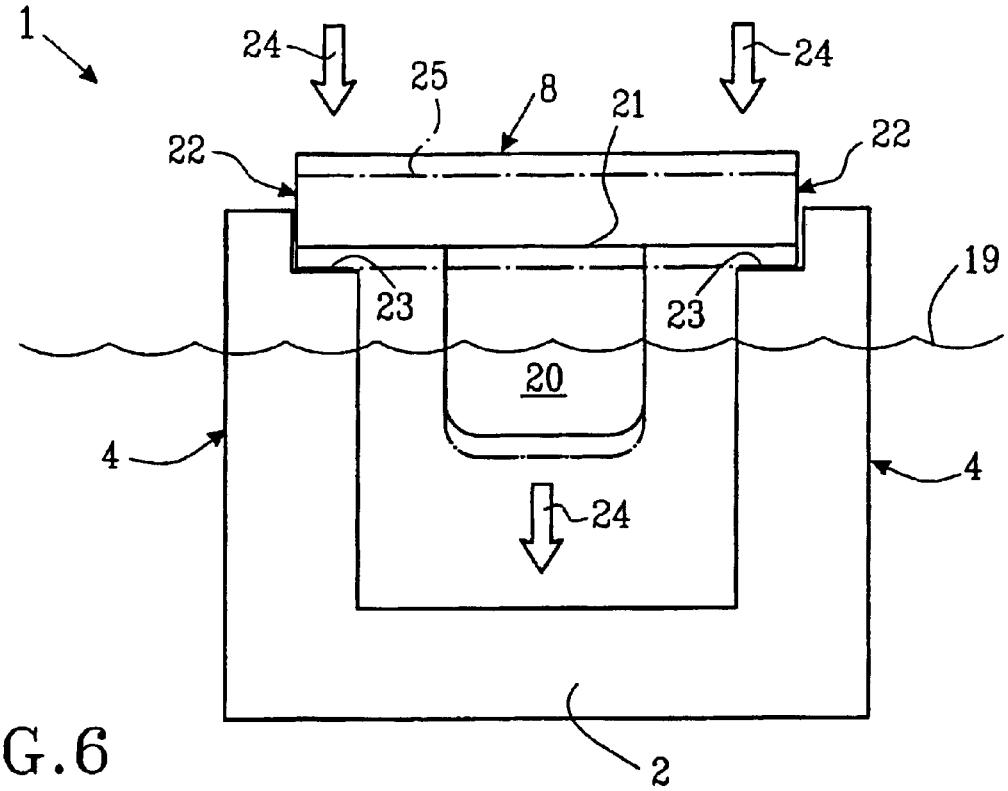
FIG. 6 shows a diagrammatic side view of a platform, illustrating a first method for positioning an operation module on the offshore platform.

The invention also discloses a first method for positioning an operation module 8 on the offshore platform 1. According to the first method, as illustrated in FIG. 6, the platform 1 is ballasted to a level—indicated by waterline 19—at which level a floating barge 20 or other vessel (not shown), with the operational module 8 placed transversely on its deck 21, may be floated in between two columns 4. The barge 20 is floated to a position in which two end-portions 22 of the operation module 8 are placed above a respective support surface 23 on the columns 4. Alternatively, the operation module 8 may be placed on brackets 10 connected to the columns 4 (as shown in FIG. 4) or on a deck 9 arranged between the columns 4 and said operation modules 8 (as shown in FIG. 1). The barge 20 is then ballasted so that the operation module 8 is set down on the offshore platform 1, as illustrated by the arrows 24 and the dash-dotted contours 25.

Figure 7:
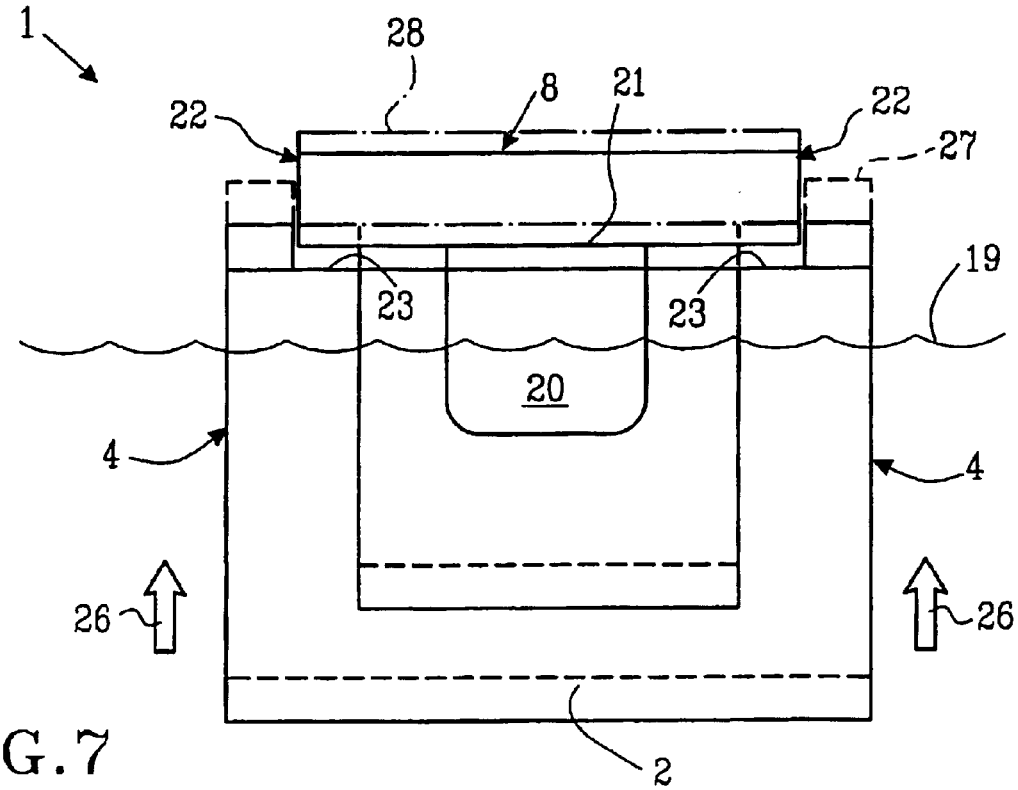
FIG. 7 shows a diagrammatic side view of a platform, illustrating a second method for positioning an operation module on the offshore platform, and FIG. 8 finally shows an embodiment wherein the platform has three columns with a generally "T"-shaped system of lateral beams.

In FIG. 7, an alternative second method is illustrated. According to this method, the offshore platform 1 is ballasted in a similar manner as in the first method to a level at which a floating barge 20 or other vessel, with the operational module placed transversely on its deck 21, may be floated in between two columns 4 to a position in which two end-portions 22 of the operation module 8 are placed above a respective support surface 23 on the columns 4 as shown in the FIG. 7. Alternatively, the operation module 8 may be placed on brackets 10 connected to the columns 4 (as shown in FIG. 4) or on a deck 9 arranged between the columns 4 and said operation modules 8 (as shown in FIG. 1). The offshore platform 1 is then de-ballasted so that the operation module 8 is lifted off said barge 20, as illustrated by the arrows 27 and the dashed contours 25 of the platform 1 as well as the dash-dotted contour 28.

In a third, not illustrated method, which is a combination of the first and the second method, the operation module 8 is placed on the platform 1 whilst maintaining a constant draught of the platform 1. This is achieved by a simultaneous ballasting of the barge 20 and a de-ballasting of the platform 1, which de-ballasting compensates for the impact of the added weight of the operation module 8 on the platform 1.

Figure 8:
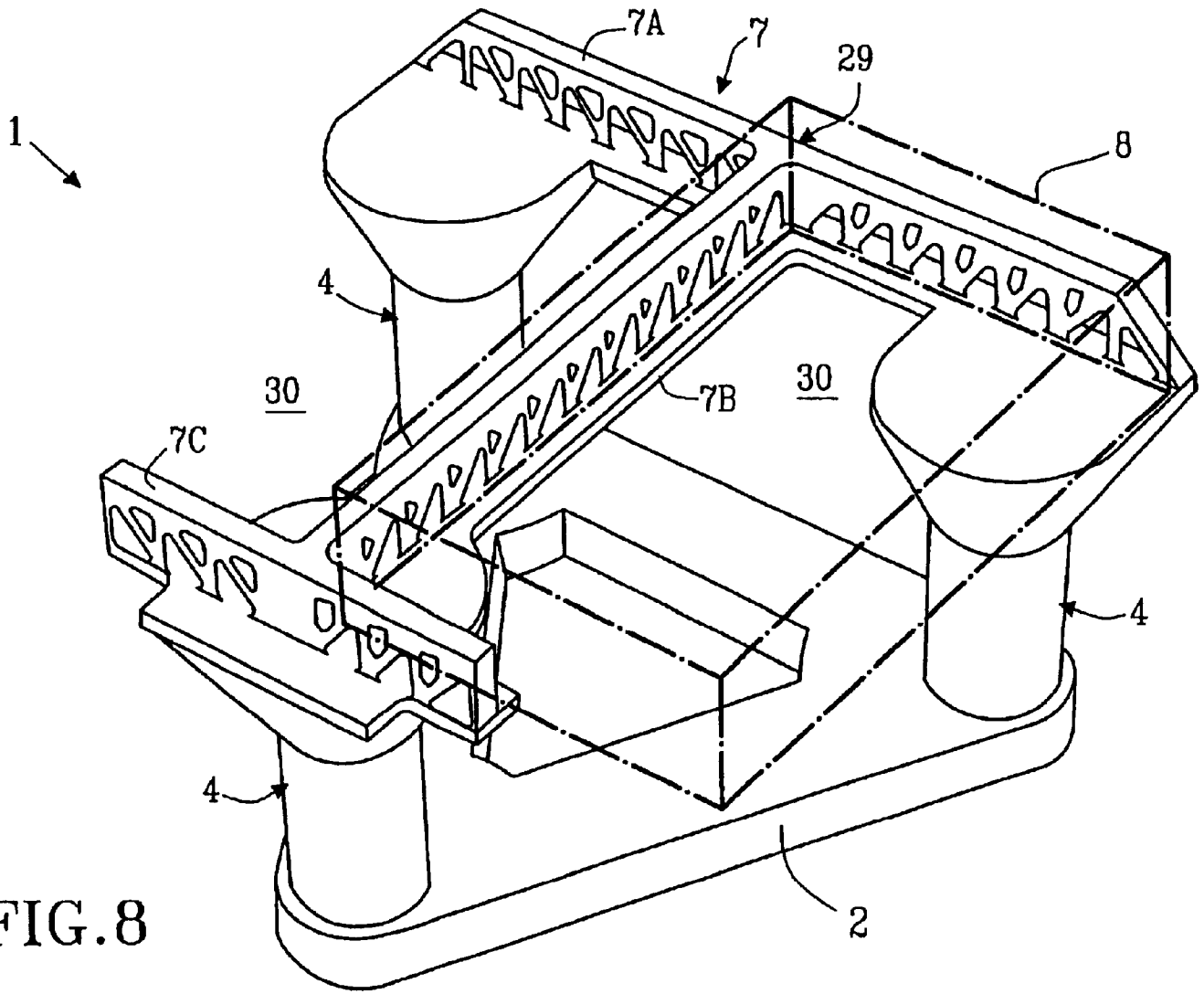

In FIG. 8, an alternative embodiment is shown, in which the offshore platform 1 has three columns 4 and a substantially triangular pontoon 2. Here, the system of lateral beams 7 is substantially T-shaped—when observed from above—in such a way that the horizontal part of the "T" corresponds a first beam 7A extending between two columns 4, and wherein the vertical part of the "T" corresponds to a second beam 7B which extends from a third column 4 to a mid-portion 29 of said first beam 7A. A third beam 7C is arranged as a "foot" of the "T", said third beam 7C being substantially perpendicular to the second beam 7B. An operation module 8—drawn with dash-dotted lines—is shown placed in one of two "slots" 30 defined between the first beam 7A and the third beam 7C.

It is to be understood that the invention is by no means limited to the embodiments described above, and may be varied freely within the scope of the appended claims.

What is claimed is:

1. A semi-submersible offshore platform (1) comprising:

a substantially ring-shaped lower pontoon (2);

at least three columns (4) extending upwardly from said lower pontoon (2), an upper beam structure (5) connecting upper portions (6) of the columns (4) with each other, and at least one operational module, said upper beam structure (5) forming a system of lateral beams (7) arranged to allow one or more of said operational modules (8) to be placed upon or adjacent to the columns (4), wherein the operational modules are placed next to the lateral beams (7), either directly on the columns (4), on brackets (10) connected to the columns (4) or on a deck arranged between upper ends of the columns (4) and said operation modules (8), the lateral beams (7) protruding vertically upwards above a bottom plane (11) of the operation modules (8).

2. A semi-submersible offshore platform (1) according to claim 1, characterized in that said bottom plane (11) of the operation modules (8) substantially coincides with a lowest through-going deck (9) of the offshore platform (1).

3. A semi-submersible offshore platform (1) according to claim 1 or 2, characterized in that said system of lateral beams (7) is arranged in such a way as to allow the operation modules (8) to extend between two adjacent columns (4).

4. A semi-submersible offshore platform (1) according one or more of the preceding claims, wherein the offshore platform (1) has four or six columns (4) and a substantially rectangular pontoon (2), and wherein a forward column pair is located on the pontoon with one column thereof on each side of a longitudinal center-line (CL), and an aft column pair is located on the pontoon (2) with one column (4) thereof on each side of said center-line (CL), characterized in that said system of lateral beams (7) is substantially H-shaped—when observed from above—in such a way that the vertical posts of the "H" correspond to two or more longitudinal beams (7*a*, 7*b*) extending on each side of said center-line (CL) from the aft column pair to the forward column pair, whilst the horizontal mid-post of the "H" corresponds to one or more transversal beams (7*c*, 7*d*, 7*e*).

5. A semi-submersible offshore platform (1) according to claim 4, characterized in that the horizontal mid-post of the "H" corresponds to an at least partially vertically open grid section (12) extending between said longitudinal beams (7*a*, 7*b*).

6. A semi-submersible offshore platform (1) according one or more of claim 1, wherein the offshore platform (1) has four or six columns (4) and a substantially rectangular pontoon (2), and wherein a starboard column pair is located on the pontoon with one column thereof on each side of a transversal midship-line (ML) through the offshore platform (1), and a port column pair is located on the pontoon (2) with one column (4) thereof on each side of said midship-line (ML), characterized in that said system of lateral beams (7) is substantially H-shaped—when observed from above—in such a way that the vertical posts of the "H" correspond to two or more transversal beams (7*g*, 7*h*) extending on each side of said midship-line (ML) from the port column pair to the starboard column pair, whilst the horizontal mid-post of the "H" corresponds to one or more longitudinal beams (7*i*, 7*j*, 7*k*).

7. A semi-submersible offshore platform (1) according to claim 6, characterized in that the horizontal mid-post of the "H" corresponds to an at least partially vertically open grid section (12) extending between said transversal beams (7*g*, 7*h*).

8. A semi-submersible offshore platform (1) according one or more of claims 1, wherein the offshore platform (1) has three columns (4) and a substantially triangular pontoon (2), characterized in that said system of lateral beams (7) is substantially T-shaped—when observed from above—in such a way that the horizontal part of the "T" corresponds a first beam (7A) extending between two columns (4), and wherein the vertical part of the "T" corresponds to a second beam (7B) which extends from a third column (4) to a mid-portion (29) of said first beam (7A).

9. A semi-submersible offshore platform (1) according to claim 8, characterized in that a third beam (7C) is arranged as a "foot" of the T, said third beam (7C) being substantially perpendicular to the second beam (7B).

10. A semi-submersible offshore platform (1) according one or more of the preceding claims, characterized in that one or more of the lateral beams (7) are formed as a torsion box (15), said torsion box (15) being wider than a typical beam (7) in the system of lateral beams (7).

11. A semi-submersible offshore platform (1) according to claim 10, characterized in that at least one side-wall (16) of said torsion box (15) coincides with a side-surface (17) of a column (4).

12. A semi-submersible offshore platform (1) according to claim 10 or 11, characterized in that the torsion box (15) is sealed from water-intrusion in such a way that it provides additional reserve buoyancy to the offshore platform (1).

13. A semi-submersible offshore platform (1) according to claim 10, characterized in that the torsion box (15) has a width which corresponds to the width of a column (4) which supports the torsion Box (15).

14. A semi-submersible offshore platform (1) according to claims 10, characterized in that the torsion box (15) is narrower than a column (4) which supports the torsion box (15), at least one side-wall (16) of the torsion box coinciding with an internal bulkhead (18) in the column (4).

15. A semi-submersible offshore platform (1) according to claim 14, characterized in that said internal bulkhead (18) is a center-line bulkhead in the column (4).

16. Method for positioning an operation module on the semi-submersible offshore platform (1) described in claim 1, characterized in that the offshore platform (1) is ballasted to a level at which a floating barge (20) or other vessel, with the operational module (8) placed transversely on its deck (21), may be floated in between two columns (4) to a position in which two end-portions (22) of the operation module (8) are placed above a respective support surface (23) on the columns (4), on brackets (10) connected to the columns (4) or on a deck (9) arranged between upper ends (6) of the columns (4) and said operation modules (8), said barge (20) or other vessel then being ballasted so that the operation module (8) is set down on the offshore platform (1).

17. Method for positioning an operation module (8) on the semi-submersible offshore platform (1) described in claim 1, characterized in that the offshore platform (1) is ballasted to a level at which a floating barge (20) or other vessel, with the operational module (8) placed transversely on its deck (21), may be floated in between two columns (4) to a position in which two end-portions (22) of the operation module (8) are placed above a respective support surface (23) on the columns (4), on brackets (10) connected to the columns (4) or on a deck (9) arranged between upper ends (6) of the columns (4) and said operation module (8), the offshore platform (1) then being de-ballasted so that the operation module (8) is lifted off said barge (20) or other vessel.

* * * * *